US009016256B2

(12) United States Patent
Hamby

(10) Patent No.: US 9,016,256 B2
(45) Date of Patent: Apr. 28, 2015

(54) CONCENTRIC CYLINDER ENGINE

(76) Inventor: W. Daniel Hamby, Valdese, NC (US)

( * ) Notice: Subject to any disclaimer, the term of this patent is extended or adjusted under 35 U.S.C. 154(b) by 297 days.

(21) Appl. No.: 13/574,804

(22) PCT Filed: Jan. 20, 2011

(86) PCT No.: PCT/US2011/021795

§ 371 (c)(1),
(2), (4) Date: Jul. 24, 2012

(87) PCT Pub. No.: WO2011/091097

PCT Pub. Date: Jul. 28, 2011

(65) Prior Publication Data

US 2012/0291743 A1 Nov. 22, 2012

Related U.S. Application Data

(60) Provisional application No. 61/282,327, filed on Jan. 25, 2010.

(51) Int. Cl.
*F02B 75/30* (2006.01)
*F02B 33/10* (2006.01)

(52) U.S. Cl.
CPC ..... *F02B 75/30* (2013.01); *F02B 33/10* (2013.01)

(58) Field of Classification Search
CPC ..... F02B 75/30; F02B 75/02; F02B 75/021
USPC ..... 123/193.1
See application file for complete search history.

(56) References Cited

U.S. PATENT DOCUMENTS

| | | | | |
|---|---|---|---|---|
| 1,024,711 | A | 4/1912 | Whidbourne et al. | |
| 1,090,991 | A | 3/1914 | Knight | |
| 2,734,494 | A * | 2/1956 | Waterval | 123/60.1 |
| 4,148,284 | A | 4/1979 | Prosen | |
| 4,434,752 | A * | 3/1984 | Bachmann | 123/50 B |
| 4,580,532 | A * | 4/1986 | Jackson | 123/52.3 |

* cited by examiner

*Primary Examiner* — Lindsay Low
*Assistant Examiner* — Jacob Amick
(74) *Attorney, Agent, or Firm* — Jeffrey Watson; Balser & Grell IP Law

(57) ABSTRACT

A concentric cylinder engine includes a toroidal outer cylinder having an inner cylinder contained therein, the inner cylinder wall comprising a sleeve assembly acting as a transfer valve. Each cylinder contains a piston, the two pistons being connected to a single crankshaft. The inner and outer piston crank throws are at least generally opposite one another, with the two pistons traveling in opposite directions during engine operation. The outer piston provides intake and compression functions, while the inner piston simultaneously provides power and exhaust functions. The concentric cylinder engine thus provides the four separate and distinct intake, compression, power, and exhaust phases of conventional Otto cycle engine operation during a single revolution of the crankshaft. The concentric cylinder engine may be constructed in multiple cylinder configurations having spark or compression ignition, in either liquid or air cooled embodiments.

20 Claims, 9 Drawing Sheets

CONCENTRIC CYLINDER ENGINE

RELATED APPLICATION

This application claims the benefit of provisional application Ser. No. 61/282,327 filed Jan. 25, 2010.

FIELD OF THE INVENTION

The present invention relates generally to reciprocating, internal combustion engines, and more particularly to a concentric cylinder engine in which the outer cylinder and piston of each cylinder pair perform the intake and compression functions of the conventional four-stroke Otto cycle of operation, with the inner cylinder and piston of the pair performing the power and exhaust functions.

BACKGROUND OF THE INVENTION

A number of different reciprocating piston internal combustion engines have been developed in the past. The most common of these engine configurations is the conventional Otto cycle spark ignition engine, with such engines having four distinct phases (i.e., intake, compression, power, and exhaust) that occur during four piston strokes in two revolutions of the crankshaft. Two-stroke cycle engines are also known and generally used in smaller engine applications. Such two stroke engines carry out two of the operating phases during each piston stroke, to complete the cycle in a single crankshaft revolution. Somewhat analogous operation occurs in compression ignition (i.e., Diesel) engines, with there being both two-stroke cycle and four-stroke cycle Diesel engines.

A chronic problem with such engines, and particularly with two-stroke cycle engines, is the contamination of the intake charge with exhaust gas and lubricating oil in the cylinder during operation. While this problem has been greatly reduced as greater emphasis has been placed upon the lowering of exhaust emissions in consideration of the environment, it nonetheless still exists in both two- and four-stroke cycle engines, and the equipment required to reduce such exhaust emissions has added hundreds of dollars to the cost of the typical automobile.

Simultaneously with the above considerations, a greater need has arisen for fuel economy. Improving fuel economy has a two-folded effect, in that it reduces the amount of exhaust emissions produced and also lowers operating costs and consumption of a finite resource. However, the modern Otto cycle reciprocating internal combustion gasoline powered engine has very nearly reached its practicable limits insofar as efficiency is concerned, with no major breakthroughs likely to be developed in the future; any such improvements are much more likely to be incremental and relatively small. Considering future planned requirements for the continuing reduction of exhaust emissions and improvements in fuel economy, it appears to some that the conventional Otto cycle gasoline powered engine may not be able to meet these standards very far into the future.

Supercharging, i.e., forced air induction wherein a greater mass of intake is provided under pressure, has been used in many cases to provide more power from a relatively smaller (and therefore lighter and more compact) engine. However, such supercharged engines universally require an external compressor, either mechanically powered or powered by exhaust pressure from the engine. The Diesel engine, particularly in its supercharged form, provides greater efficiency and fuel economy, but the emissions produced by Diesel engines are at least as difficult to control as those produced by spark ignition engines.

Thus, an engine solving the aforementioned problems is desired. The instant invention of a concentric cylinder engine is designed to address the above mentioned problems.

SUMMARY OF THE INVENTION

The concentric cylinder engine includes an outer piston having a toroidal planform, and a generally conventional inner piston. An outer cylinder and sleeve surround the outer piston, with the inner cylinder of the inner piston comprising a fixed sleeve and a sliding sleeve that acts as a transfer valve between the two cylinder volumes. The outer piston and cylinder perform the intake and compression phases of the engine operation, while the inner piston and cylinder perform the power and exhaust functions of engine operation. The two pistons are connected to a common crankshaft, with the inner piston throw and the outer piston throws being generally opposite one another, although this may be adjusted, if desired.

The inner piston drives the operation of the engine during its downward power stroke, as the outer piston rises in its outer cylinder to compress the previously ingested intake charge. The sleeve valve separating the two pistons opens at or near the end of the two phases, with the compressed intake charge from the outer cylinder flowing into the larger volume of the inner cylinder at this point as the inner piston is at or near the bottom of its travel. The flow path of the intake charge delivers this intake charge to the lowermost portion of the inner cylinder, below the exhaust gases escaping through the now open exhaust valve(s) in the cylinder head and assisting in scavenging the exhaust gases from the cylinder.

When these two simultaneous phases have been completed, the sleeve valve closes and the direction of travel of both pistons reverses, with the inner piston rising to expel the spent exhaust gases from the inner cylinder and further compressing the fresh intake charge, once the exhaust valve closes. The outer piston simultaneously descends in its cylinder to draw in a fresh intake charge. Thus, the concentric cylinder engine operates using four distinct phases of operation, i.e., intake, compression, power, and exhaust, but accomplishes these phases in only two strokes of each piston in a single crankshaft revolution due to the simultaneous operation of the two pistons.

The concentric cylinder engine may be constructed as a spark ignition engine or as a compression ignition (i.e., Diesel) engine, as desired. Fuel delivery may be accomplished by conventional means, i.e., carburetion, or throttle valve or direct fuel injection. Cooling may be provided by liquid or air-cooling means. Cooling requirements may be reduced due to the flow path of the intake charge as it enters the transfer sleeve assembly at the relatively hotter cylinder head and flows along the walls of the inner cylinder. It will be seen that the relative displacements of the inner and outer cylinders may be adjusted, e.g., to provide a relatively larger intake and compression volume for the outer cylinder to serve as a supercharger for the inner cylinder. As the throws of the crankshaft are distinct for the two pistons, such adjustment of the relative displacements of the two cylinders may be accomplished by adjusting the inner and outer diameters of the outer cylinder, and/or adjusting the relative stroke length between the two pistons.

These and other features of the present invention will become readily apparent upon further review of the following specification and drawings.

BRIEF DESCRIPTION OF THE DRAWINGS

For the purpose of illustrating the invention, there is shown in the figures a form that is presently preferred; it being understood, however, that this invention is not limited to the precise arrangements and instrumentalities shown.

Similar reference characters denote corresponding features consistently throughout the attached drawings.

DETAILED DESCRIPTION

The concentric cylinder engine of the instant invention has an outer cylinder and outer piston of toroidal configuration that provides the intake and compression functions of engine operation, and an inner cylinder and inner circular piston that provide the power and exhaust functions. As the two pistons reciprocate generally opposite one another, two phases of the conventional four-stroke cycle are carried out simultaneously at all times, thus delivering all four phases of the cycle in only two strokes of each piston, i.e., a single crankshaft revolution.

Concentric, as used herein, is used to describe objects that share the same center, axis or origin with one inside the other (e.g., circles, tubes, cylindrical shafts, disks, and spheres may be concentric to one another). Concentric objects generally have different radii, as concentric objects with the same radius are equal. One of the most familiar examples of concentric circles are the evenly spaced circles of a target used in target archery or firearms, and accordingly any concentric design may be called a "target" or a "bullseye" (after the center).

Toroidal, as used herein, is a term used to describe a toroid or doughnut-shaped object, such as an O-ring. The annular shape of a toroid is generated by revolving a geometrical figure around an axis external to that figure. For example, when a rectangle is rotated around an axis parallel to one of its edges then a hollow cylinder may be produced, which may resemble a piece of pipe with a wall thickness.

Figure 1A:
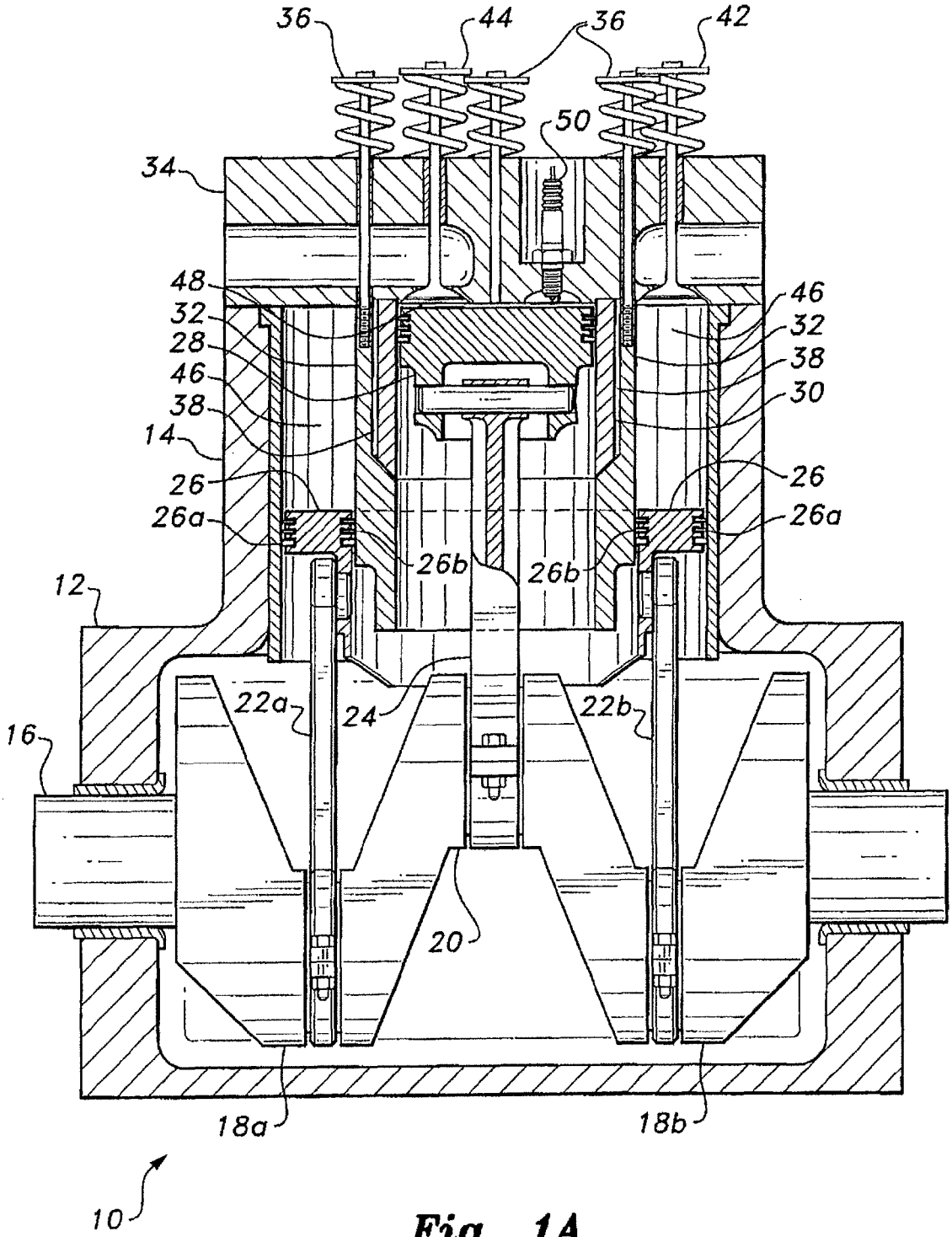
FIG. 1A illustrates a side elevation view in section of a concentric cylinder engine according to the present invention, showing the outer and inter pistons at bottom and top dead center, respectively.

Referring to the drawings, wherein like numerals indicate like elements, there is shown in FIGS. 1A through 4B an embodiment of a concentric cylinder engine 10. FIGS. 1A and 1B of the drawings illustrate a side elevation view in section and a front elevation view in section, respectively, of an exemplary concentric cylinder engine 10. The engine 10 includes a crankcase 12 having an outer cylinder 14 affixed thereto and extending therefrom. While the crankcase 12 and outer cylinder 14 are shown in the drawings as a single unitary structure, it will be understood that this is a simplification for clarity in the drawings, and these components will comprise conventional multiple piece structures to facilitate assembly and disassembly of the engine 10.

A crankshaft 16 rotates within the crankcase 12, the crankshaft 16 having two outer piston throws 18*a*, 18*b* and an inner piston throw 20 disposed therebetween. The inner piston throw 20 is generally 180D opposite the two outer piston throws 18*a*, 18*b*, and is shown as such in the appropriate drawings. However, it will be understood that these outer and inner piston throws may have less than 180° opposite therebetween, if so desired. The rotational angle between the two outer throws 18*a*, 18*b* and the inner throw 20 may be adjusted to alter the mechanical timing between the various intake, compression, power, and exhaust phases provided by the engine 10.

Two outer piston connecting rods 22*a* and 22*b* extend from the two outer crankshaft throws 18*a*, 18*b*, and a single inner connecting rod 24 extends from the single inner throw 20 of the crankshaft 16. The two outer rods 22*a*, 22*b* connect to opposite sides of an outer piston 26, with the single inner rod 24 connecting to the inner piston 28. The inner piston 28 has a generally conventional configuration, i.e., a circular planform. However, the outer piston 26 has a toroidal planform, with a circular outer surface 26*a* that reciprocates within the outer cylinder 14 (or more precisely the outer cylinder liner, as shown) and a circular inner surface 26*b* that bears against a sleeve assembly separating the toroidal outer piston 26 from the inner piston 28.

The sleeve assembly comprises a fixed inner sleeve 30 and an outer sleeve 32 that reciprocates concentrically about the inner sleeve. The inner sleeve 30 is affixed to and depends from the cylinder head 34 into the outer cylinder 14, with the cylinder head 34 being affixed to and closing the outer cylinder 14 opposite the crankcase 12. The outer sleeve 32 is a reciprocating sleeve valve, with actuation provided by a series of sleeve valve actuators 36 that pass through the cylinder head 34 and attach (e.g., threaded connections, etc.) to the sleeve valve 32. The actuators 36 may be operated conventionally, e.g., via cams or rockers and shafts driven from the crankshaft, etc.

The fixed inner sleeve 30 and reciprocating outer sleeve valve 32 define a generally toroidal intake charge passage 38 therebetween, with the inner surface of the fixed inner sleeve 30 having closely fitting guides 40 thereon (shown in FIGS. 3A and 3B) that define channels therebetween to allow the intake charge to flow through the passage 36 when the outer sleeve valve 32 is opened. The engine 10 further includes at least one intake valve 42 and exhaust valve 44, which operate conventionally via cams, rocker shafts and arms, etc. A plurality of intake and exhaust valves 42 and 44 may be provided, if desired, particularly in the case of the intake valve located around the toroid defined by the outer piston 26.

Figure 1B:
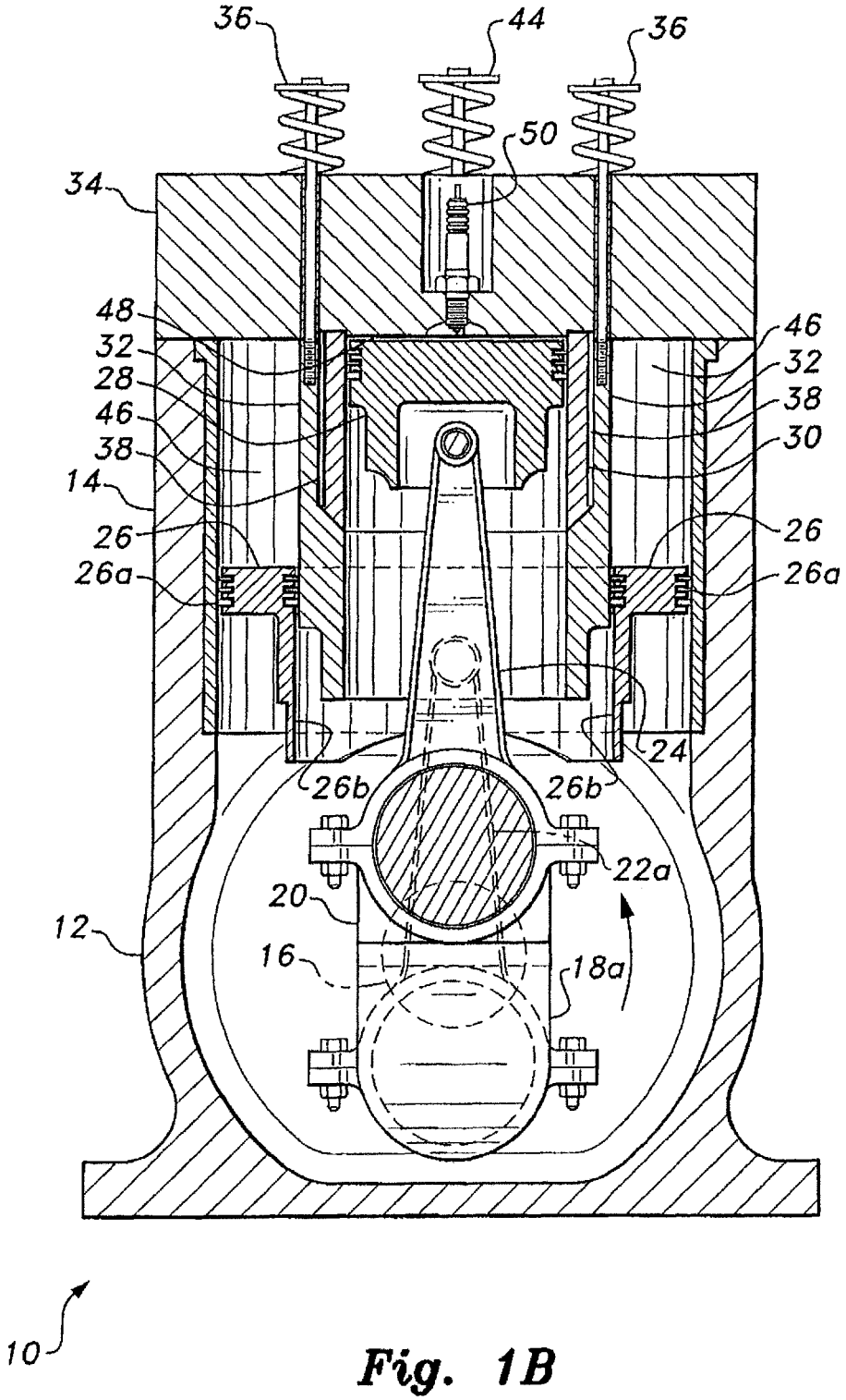
FIG. 1B illustrates a front elevation view in section of the concentric cylinder engine of FIG. 1A, showing the engine at the same point in its operating cycle as shown in FIG. 1A.
Figure 2A:
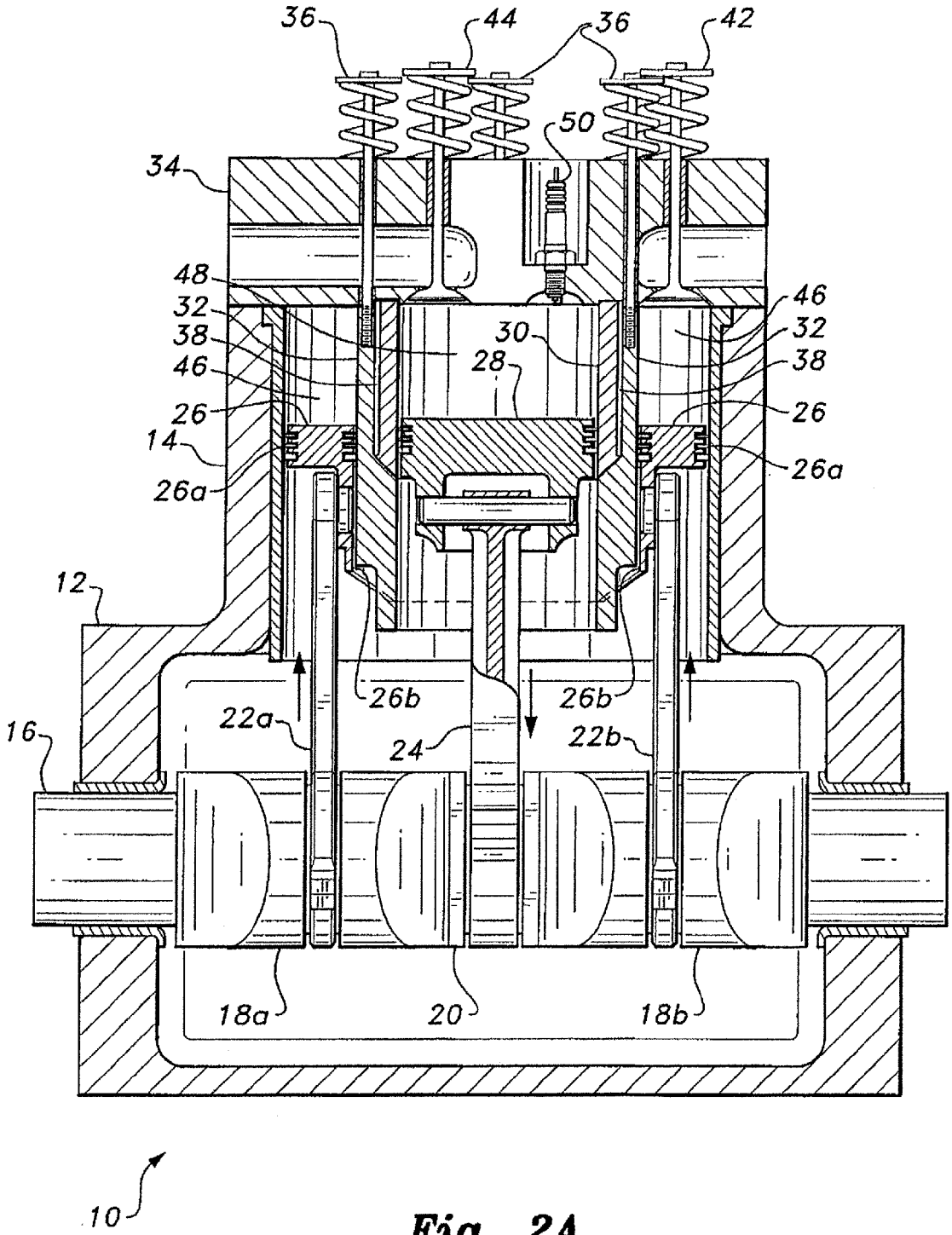
FIG. 2A illustrates a side elevation view in section of the concentric cylinder engine of FIGS. 1A and 1B, showing he outer and inner pistons substantially at the midpoints of their travel.
Figure 2B:
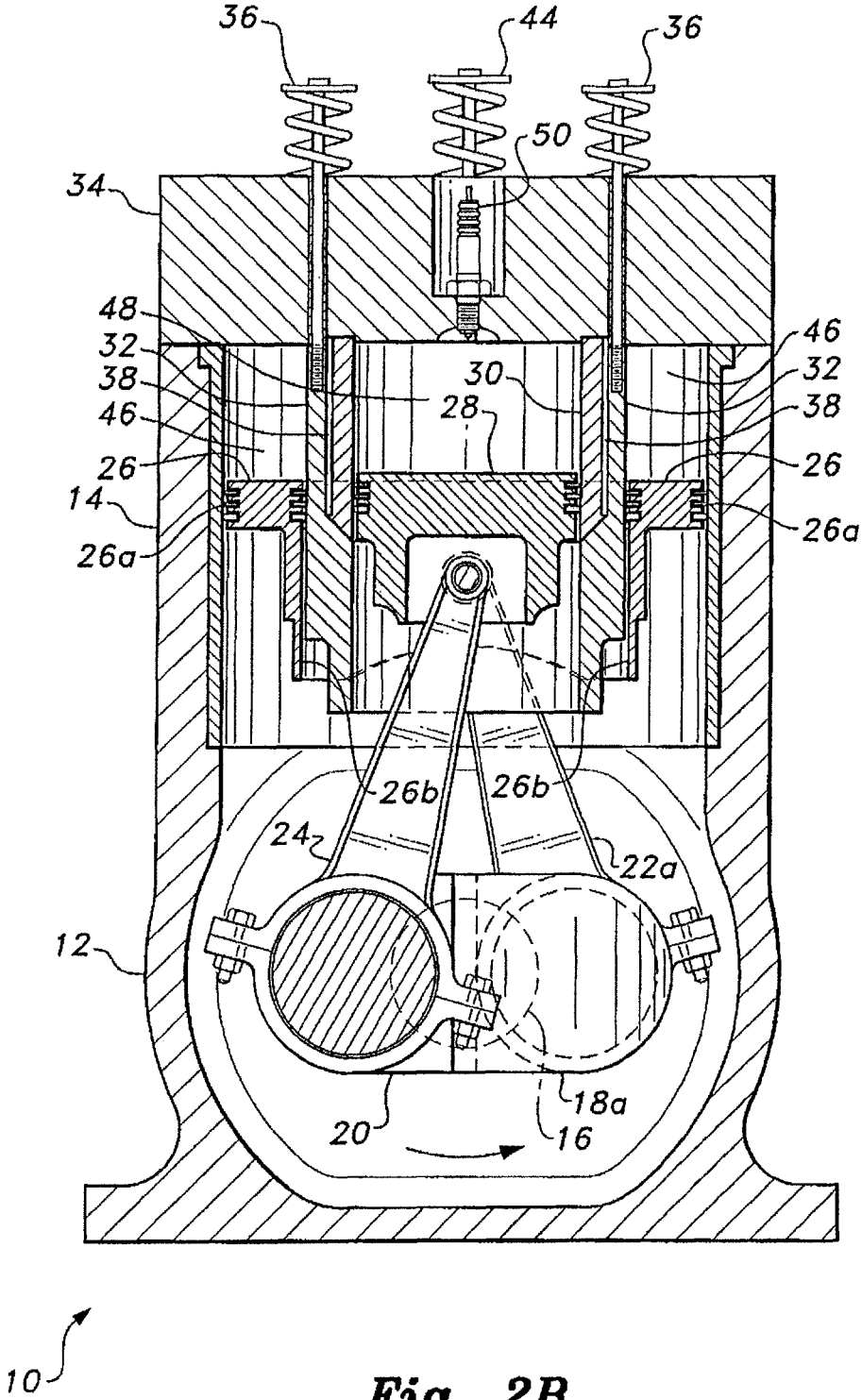
FIG. 2B illustrates a front elevation view in section of the concentric cylinder engine of FIG. 2A, showing the engine at the same point in its operating cycle as shown in FIG. 2A.
Figure 3A:
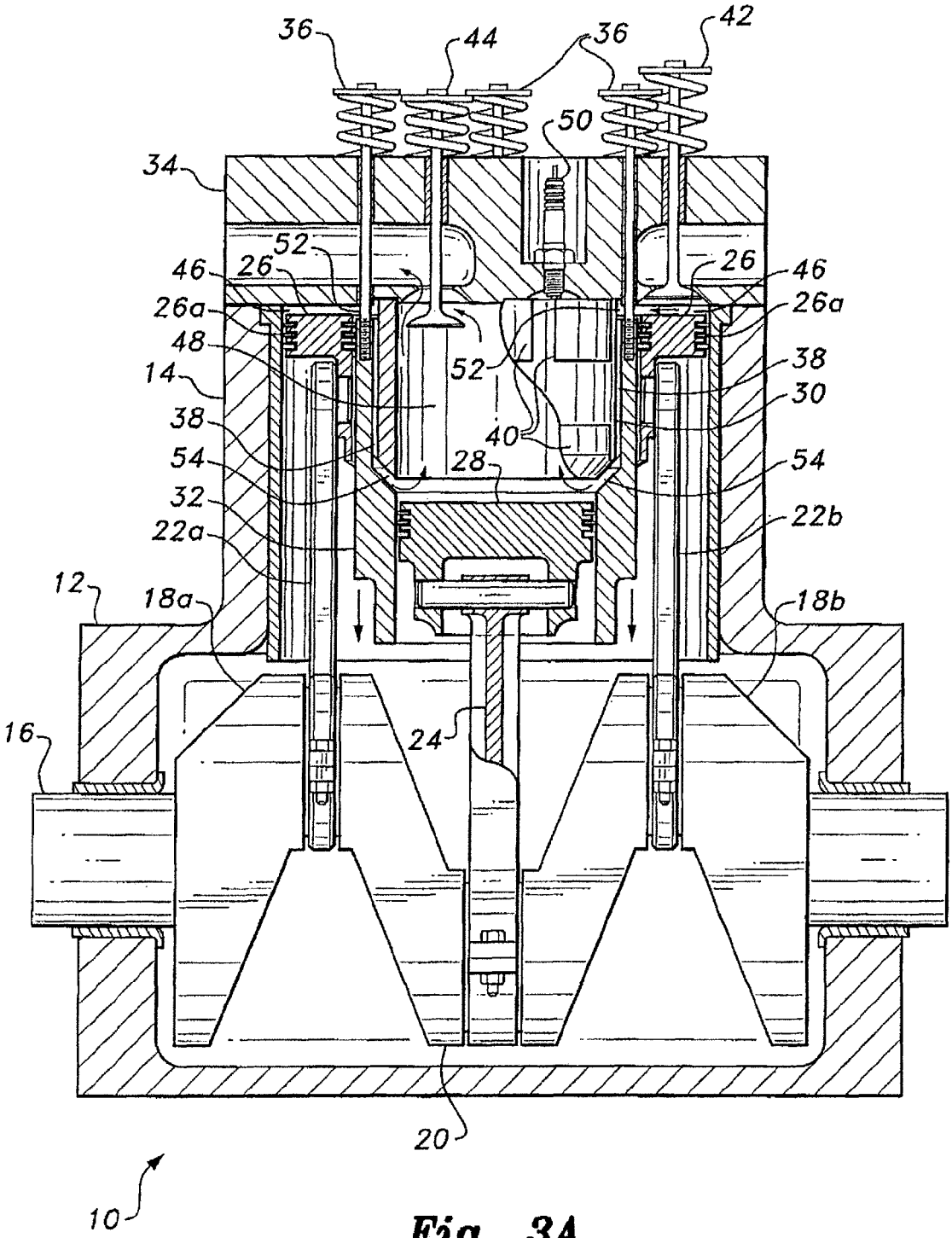
FIG. 3A illustrates a side elevation view in section of the concentric cylinder engine of FIGS. 1A through 2B, showing the outer and inner pistons at top and bottom dead center, respectively.
Figure 3B:
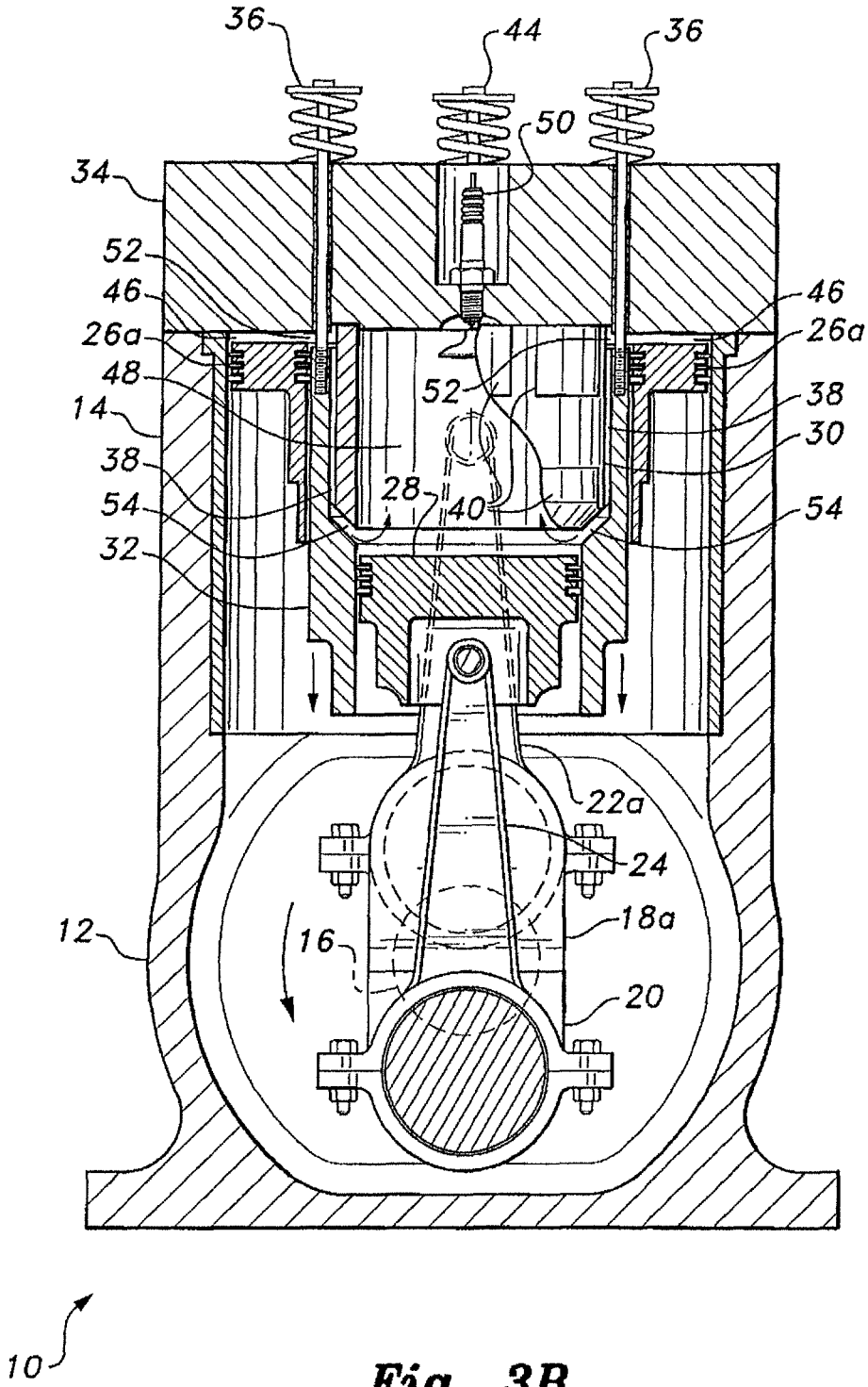
FIG. 3B illustrates a front elevation view in section of the concentric cylinder engine of FIG. 3A, showing the engine at the same point in its operating cycle as shown in FIG. 3A.
Figure 4A:
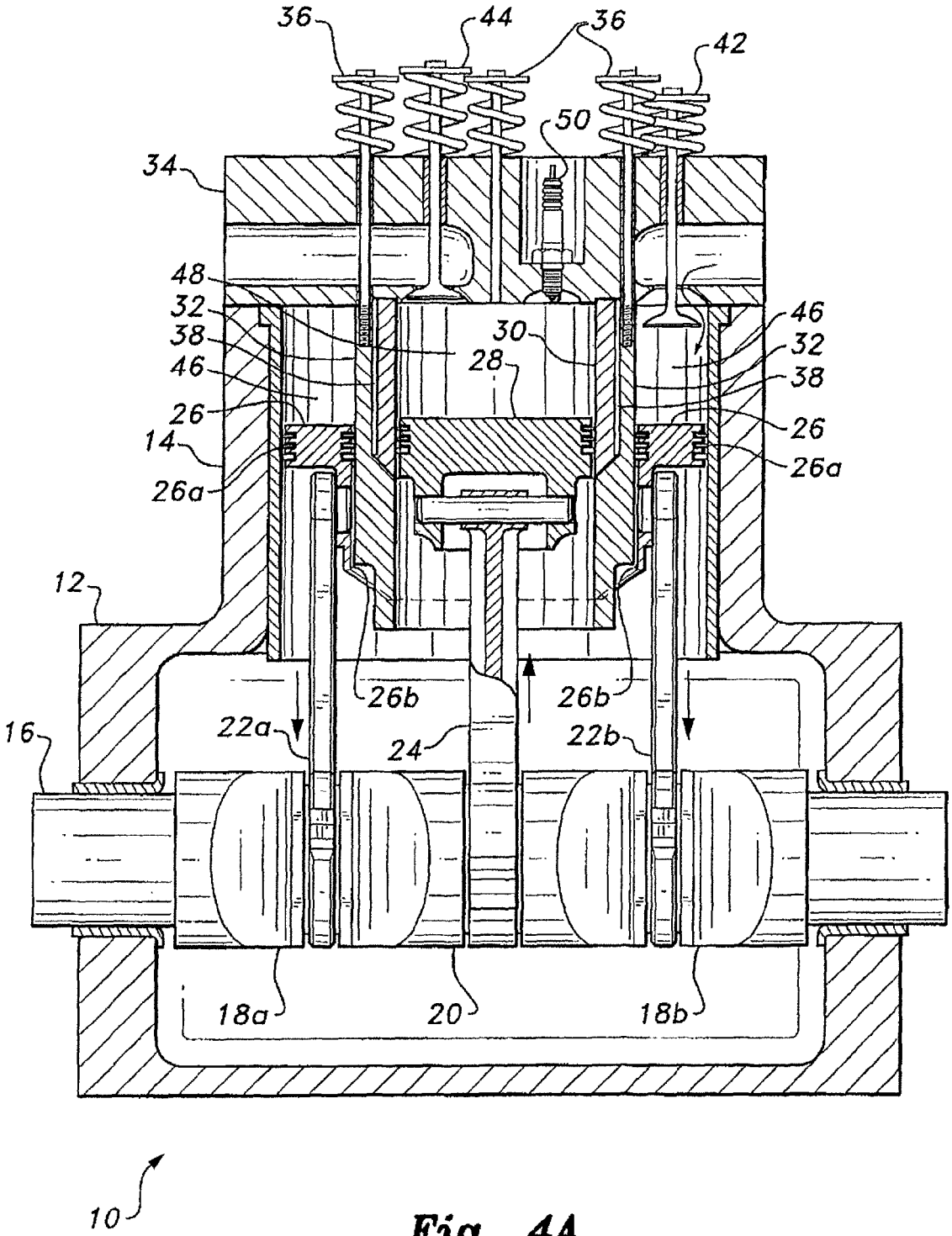
FIG. 4A illustrates a side elevation view in section of the concentric cylinder engine of FIGS. 1A through 3B, showing the outer and inner pistons substantially at the midpoints of their travel after 270° of crankshaft rotation from the point in the cycle shown in FIGS. 1A and 1B.
Figure 4B:
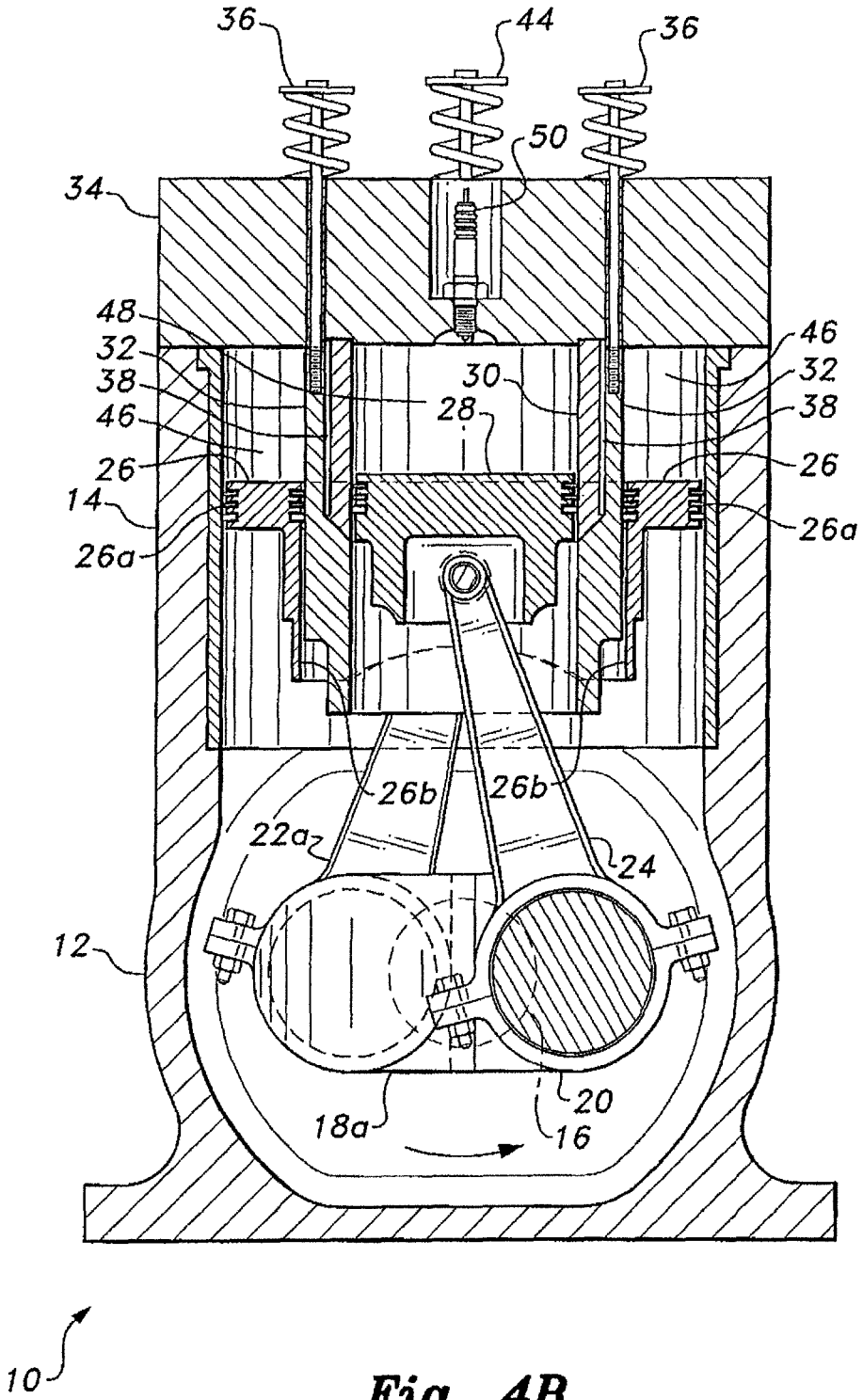
FIG. 4B illustrates a front elevation view in section of the concentric cylinder engine of FIG. 4A, showing the engine at the same point in its operating cycle as shown in FIG. 4A.

FIGS. 2A, 3A, and 4A are views in section of the engine 10 from the same orientation as FIG. 1A, with FIGS. 2B, 3B, and 4B having the same orientation as FIG. 1B. However, each successive pair of FIGS. 2A and 2B, 3A and 3B, etc.) shows the crankshaft 16 and internal mechanisms of the engine 10 rotated by 90° from the initial position shown in FIGS. 1A and 1B. FIGS. 1A through 4B are used to explain the operation of the engine 10.

In FIGS. 1A and 1B, the inner piston 28 is shown at top dead center, while the outer piston 26 is at bottom dead center. Again, although the exemplary FIGS. 1A through 4B show the crank throws 20 and 18*a*, 18*b* for the pistons 28 and 26 being 180° apart, the angular relationship between the inner and outer piston crank throws may be adjusted as desired to optimize operation. At the point of the cycle shown in FIGS. 1A and 1B, the outer piston 26 has completed its downward travel within the outer cylinder 14 to maximize the outer or intake and compression volume 46 defined by the outer cylinder, sleeve assembly, outer piston, and cylinder head. The intake valve 42 was previously open to allow this volume 46 to fill with a fresh intake charge, and is now closed to capture that charge within the outer volume 46.

Simultaneously with the above, the inner piston 28 has reached top dead center, thereby minimizing the inner cylinder volume 48. At the point shown in FIGS. 1A and 1B, the spark plug 50 (for a spark ignition engine, as opposed to Diesel operation) will have just fired some several degrees before the inner piston 28 reached top dead center, as is conventional in reciprocating internal combustion engines. This initiates the power stroke, driving the inner piston 28 downwardly within its cylinder comprising the sleeve assembly of the fixed inner sleeve 30 and surrounding sleeve valve 32. The power stroke of the inner piston 28 drives the toroidal outer piston 26 upwardly within the outer cylinder 14, due to the mechanical linkage of the crankshaft 16 and connecting rods 22*a*, 22*b*, and 24.

FIGS. 2A and 2B illustrate the resulting positions of the moving mechanical components of the engine 10 when the crankshaft 16 has rotated 90° counterclockwise from its orientation in FIGS. 1A and 1B. The inner piston 28 has descended within the sleeve assembly to a point about halfway between top and bottom dead center. The toroidal outer piston 26 is simultaneously moving upwardly within the outer cylinder volume 46. All of the valves, i.e., intake valve 42, exhaust valve 44, and transfer sleeve valve 32, are closed at this point to maximize the downward thrust of the power stroke of the inner piston 28 and the compressive force of the rising toroidal outer piston 26.

In FIGS. 3A and 3B, the crankshaft 16 is shown rotated 180° from its position in FIGS. 1A and 1B, with the inner piston 28 at bottom dead center and the toroidal outer piston 26 at top dead center. (Again, the two pistons 28 and 26 will not simultaneously be at bottom and top dead center if their respective crank throws are at other than 180° from one another.) In the example of FIGS. 3A and 3B, the exhaust valve 44 has opened to allow the spent exhaust gases to leave the inner cylinder as the inner piston 28 begins its upward travel. Simultaneously with the above, the sleeve transfer valve 32 has been pushed downwardly by its actuators 36. This opens an upper circumferential passage 52 between the upper edge of the sleeve valve 32 and the overlying cylinder head 34, and a lower circumferential passage 54 between the lower edge of the fixed inner sleeve 30 and an intermediate shoulder of the sleeve valve 32.

When this occurs, the compressed intake charge is forced form the outer cylinder intake and compression volume 46 through the upper circumferential passage 52, downwardly between the fixed inner sleeve 30 and the sleeve valve 32, and through the lower circumferential passage 54 into the lower portion of the inner cylinder volume 48. Although the exhaust valve 44 is open simultaneously with the inflow of the fresh intake charge described above and shown in FIGS. 3A and 3B, it will be seen that little, if any, of the fresh intake charge will escape through the open exhaust valve 44. This is due to the flow path of the intake charge entering the inner cylinder volume 48 at its lowest point immediately adjacent to the crown of the inner piston 28, while the exhaust valve 44 is at the opposite end of the inner cylinder.

The incoming fresh intake charge, thus, provides certain benefits as it flows into the inner cylinder volume. First, the expansion of the intake charge as it flows from the high pressure area of the compressed outer cylinder volume 46 to the lower pressure of the inner cylinder 48, provides some cooling of the inner cylinder walls. Also, the entrance of the fresh intake charge into the lower portion of the inner cylinder volume 48 assists in flushing the spent exhaust gases through the open exhaust valve 44 in the cylinder head 34. This allows the exhaust valve 44 to be closed somewhat earlier than might be the case with conventional Otto cycle engines, thereby providing significant additional compression of the intake charge within the inner cylinder volume 48 as the inner piston 28 rises.

FIGS. 4A and 4B are illustrations of the inner and outer piston positions when the crankshaft 16 has rotated through 270° from its initial position as shown in FIGS. 1A and 1B. In FIGS. 4A and 4B, the two pistons 26 and 28 are again at about their midpoints between top dead center and bottom dead center, with the outer piston 26 traveling downward to draw in a fresh intake charge through the open intake valve 42. The inner piston 28 is simultaneously traveling upward to compress the previously drawn in intake charge, the sleeve transfer valve 32 and the exhaust valve 44 now being closed. The intake charge is further compressed as the inner piston 28 continues to rise, with ignition occurring at some point before the inner piston reaches top dead center in order to maximize power and efficiency. The process then begins anew, returning to the situation illustrated in FIGS. 1A and 1B and repeating through FIGS. 4A and 4B for each revolution of the crankshaft.

Figure 5:
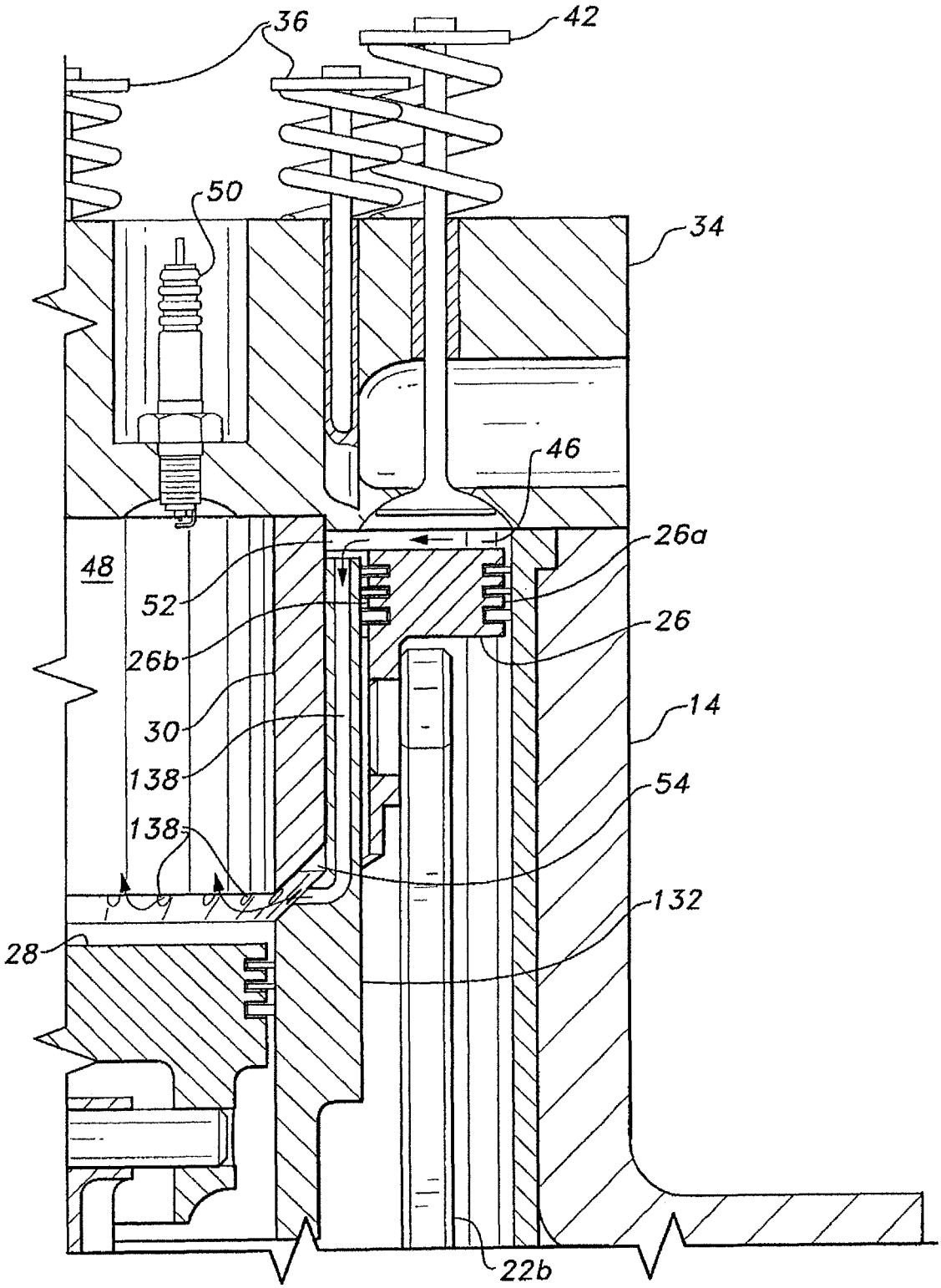
FIG. 5 illustrates a partial detailed elevation view in section of an alternative embodiment of a concentric cylinder engine according to the present invention, showing an alternative sleeve valve configuration from that shown in FIGS. 1A through 4B.

FIG. 5 provides a partial side elevation view in section showing details of an alternative sleeve valve configuration. In the embodiment of FIG. 5, the basic configuration of the engine is essentially the same as that illustrated in FIGS. 1A through 4B and discussed further above. However, the reciprocating sleeve transfer valve 132 is somewhat different from the sleeve valve 32, with the sleeve valve 132 containing a series of transfer passages 138 integrally therein. These transfer passages 138 provide the same function as the toroidal intake passage 38 shown in FIGS. 1A through 4B, but instead comprise a series of separately formed passages extending downwardly through the thickness of the wall of the sleeve valve 132 and inwardly to exit from the shoulder of the sleeve valve 132. There is no discernible space or passage between the inner surface of the sleeve valve 132 and the outer surface of the fixed sleeve 30, in this embodiment.

The sleeve transfer valve 132 is shown opened in FIG. 5, allowing the fresh intake charge to pass from the small compressed outer cylinder volume 46, through the open space or gap 52 at the top of the transfer valve 132, downwardly through its passages 138, and thence through the open gap 54 between the lower edge of the fixed sleeve 30 and the shoulder of the transfer valve 132. The remaining operation of the engine shown in FIG. 5 is essentially the same as that shown in FIGS. 1A through 1B and described further above.

It will be readily recognized that various additional alternative embodiments may be developed for the concentric cylinder engine 10. It is important to note that although only a single cylinder engine is illustrated in FIGS. 1A through 4B, the concentric cylinder engine in any of its embodiments may be readily adapted as a multi-cylinder engine of any practicable configuration, e.g., inline, opposed, Vee, radial, etc. Moreover, the cooling needs of the concentric cylinder engine may be accommodated by any conventional system, i.e., liquid or air cooling. It will be appreciated that much of the cooling requirement for the engine is met by the flow of the intake charge around the sides of the fixed inner sleeve. However, additional cooling may be provided for the cylinder head and also for the outer cylinder wall, if it is deemed necessary.

The concentric cylinder engine 10 in its various embodiments is an inherently smooth running engine, particularly when the masses of the inner and outer pistons and rods are balanced relative to one another, as is preferable in the engine. This is due to the opposite reciprocation of the inner and outer pistons relative to one another during operation, particularly when the inner and outer piston crank throws are essentially 180° opposed to one another.

It will also be seen that while the illustrations in FIGS. 1A through 4B show the inner and outer positions subtending substantially equal areas and their crank throws having essentially the same offset from the center of the crankshaft to provide substantially equal volumetric displacements, these dimensions may be varied. For example, the outer piston may have somewhat greater outer diameter than that illustrated, thus providing a relatively greater total area (and thus greater displacement) in comparison to the inner piston. This will provide a relatively larger volume of intake charge with each stroke, in effect providing a higher ratio of supercharging to the inner piston. Much the same effect may be achieved by lengthening the stroke of the two outer piston crank throws relative to the inner piston throw, or the two effects may be combined with one another to increase the displacement of the outer cylinder and piston relative to the inner cylinder and piston.

Also, while a connecting rod and offset crankshaft throws have been illustrated and described for the transfer of the reciprocating motion of the pistons to the rotary motion of the crankshaft (and vice versa), it will be seen that other means for carrying out this motion transfer may be provided. For example, the reciprocating motion of either of the pistons may be used to drive a rack thereon that, in turn, rotates a pinion to drive a rack residing on the opposite piston. Alternatively, a rocker shaft and rocker arm arrangement may be used to drive the opposite reciprocation of the two pistons, the two ends of the rocker arm oscillating in opposite directions about a central pivot to drive the two pistons oppositely.

The present invention may be embodied in other forms without departing from the spirit and the essential attributes thereof, and, accordingly, reference should be made to the appended claims, rather than to the forgoing specification, as indicated in the scope of the invention. As a result, it is to be understood that the present invention is not limited to the embodiments described above, but encompasses any and all embodiments within the scope of the following claims.

I claim:

1. A concentric cylinder engine comprising:

a crankcase;

a crankshaft rotationally disposed within the crankcase, the crankshaft having two outer piston crank throws and an inner piston crank throw disposed therebetween, the outer piston crank throws offset generally opposite the inner piston crank throw;

an outer cylinder extending from the crankcase; a generally toroidal outer piston disposed within the outer cylinder, the outer piston reciprocally communicating with the outer piston crank throws of the crankshaft;

a sleeve assembly having a sleeve valve reciprocally disposed within the outer piston;

an inner piston disposed within the sleeve assembly, the inner piston reciprocally communicating with the inner piston crank throw of the crankshaft;

said sleeve valve assembly comprising:

a fixed inner sleeve affixed to and depending from a cylinder head and extending down into the outer cylinder below the inner piston at the top of the inner piston stroke; and an outer sleeve being adapted to reciprocate concentrically about said inner sleeve;

whereby when said outer sleeve valve is opened by reciprocating down from said inner sleeve at the bottom of the inner piston stroke, said inner sleeve and said outer sleeve define a generally toroidal intake charge passage therebetween above the top of said inner piston.

2. The concentric cylinder engine of claim 1 wherein the engine is adapted to operate using four distinct phases of operation, an intake phase, a compression phase, a power phase, and an exhaust phase, whereby each phase being completed in only two strokes of each piston and a single crankshaft revolution due to the simultaneous operation of the two pistons.

3. The concentric cylinder engine of claim 2 wherein said outer piston and cylinder are adapted to perform the intake and compression phases of the engine operation, while said inner piston and cylinder simultaneously performing the power and exhaust phases of engine operation.

4. The concentric cylinder engine of claim 3 wherein:

said inner piston being adapted to drive the operation of the engine during its downward power stroke, while said outer piston rises in its outer cylinder to compress the previously ingested intake charge;

said sleeve valve being adapted to separate the two pistons opens at or near the end of the two simultaneous phases, whereby the compressed intake charge from said outer cylinder flowing into the larger volume of said inner cylinder at this point as said inner piston being at or near the bottom of its travel; and said sleeve valve being adapted to close when the two simultaneous phases being completed, whereby the direction of travel of both pistons reversing, with said inner piston rising to expel the spent exhaust gases from said inner cylinder and further compressing the fresh intake charge, once the exhaust valve closes, and said outer piston simultaneously descending in its cylinder to draw in a fresh intake charge.

5. The concentric cylinder engine of claim 1 being constructed as a spark ignition engine with at least one spark plug.

6. The concentric cylinder engine of claim 1 being constructed as a compression ignition engine.

7. The concentric cylinder engine of claim 1 further comprising:

two outer piston connecting rods extending from the two outer crankshaft throws and connecting to opposite sides of the outer piston; and a single inner connecting rod extending from the single inner throw connecting to the inner piston.

8. The concentric cylinder engine of claim 1 wherein said inner piston has a circular planform.

9. The concentric cylinder engine of claim 1 wherein said generally toroidal outer piston having:

a circular outer surface being adapted to reciprocate within the outer cylinder; and a circular inner surface being adapted to bear against said sleeve assembly, thereby separating the toroidal outer piston form the inner piston.

10. The concentric cylinder engine of claim 1 wherein said cylinder head being affixed to and closing the outer cylinder opposite the crankcase.

11. The concentric cylinder engine of claim 10 wherein said outer sleeve being a reciprocating sleeve valve, whereby actuation being provided by a series of sleeve valve actuators that pass through the cylinder head and attach to said sleeve valve.

12. The concentric cylinder engine of claim 10 wherein the inner surface of the fixed inner sleeve having closely fitting guides thereon that define channels therebetween adapted to allow the intake charge to flow through the intake charge passage when the outer sleeve valve is open.

13. The concentric cylinder engine of claim 1 wherein said sleeve valve assembly comprises:

a series of integrally spaced transfer passages being adapted to provide a series of separately formed passages extending downwardly through the thickness of the wall of the sleeve valve.

14. The concentric cylinder engine of claim 1 further comprising: at least one intake valve and exhaust valve.

15. The concentric cylinder engine of claim 13 comprising a plurality of intake valves located around toroidal outer piston.

16. The concentric cylinder engine of claim 1 having a compression volume defined by the outer cylinder, the sleeve assembly, the outer piston, and the cylinder head.

17. A concentric cylinder engine comprising:

a crankcase;

a crankshaft rotationally disposed within the crankcase, the crankshaft having two outer piston crank throws and an inner piston crank throw disposed therebetween;

an outer cylinder extending from the crankcase; a generally toroidal outer piston disposed within the outer cylinder;

two piston connecting rods reciprocally connecting the outer piston to the outer piston crank throws of the crankshaft;

a sleeve assembly concentrically disposed within the outer piston;

an inner piston concentrically disposed within the sleeve assembly; and an inner piston connecting rod reciprocally connecting the inner piston to the inner piston crank throw of the crankshaft;

said sleeve valve assembly comprising:

a fixed inner sleeve affixed to and depending from a cylinder head and extending down into the outer cylinder below the inner piston at the top of the inner piston stroke; and an outer sleeve being adapted to reciprocate concentrically about said inner sleeve;

whereby when said outer sleeve valve is opened by reciprocating down from said inner sleeve at the bottom of the inner piston stroke, said inner sleeve and said outer sleeve define a generally toroidal intake charge passage therebetween above the top of said inner piston.

18. The concentric cylinder engine of claim 17 wherein the engine being adapted to operate using four distinct phases of operation, an intake phase, a compression phase, a power phase, and an exhaust phase, whereby each phase being completed in only two strokes of each piston and a single crankshaft revolution due to the simultaneous operation of the two pistons.

19. A concentric cylinder engine comprising:

a crankcase;

a crankshaft rotationally disposed within the crankcase, the crankshaft having two outer piston crank throws and an inner piston crank throw disposed therebetween;

an outer cylinder extending from the crankcase; a cylinder head closing the outer cylinder opposite the crankcase;

a sleeve assembly;

an inner piston disposed within the sleeve assembly, the inner piston reciprocally communicating with the inner piston crank throw of the crankshaft;

said sleeve assembly having a fixed sleeve affixed to and depending from the cylinder head down into the outer cylinder below the inner piston at the top of the inner piston stroke and a sleeve valve reciprocally disposed concentrically about the fixed sleeve; a generally toroidal outer piston disposed within the outer cylinder, the outer piston reciprocally communicating with the outer piston crank throws of the crankshaft, whereby when said sleeve valve is opened by reciprocating down from said fixed sleeve at the bottom of the inner piston stroke, said fixed sleeve and said sleeve valve define a generally toroidal intake charge passage therebetween above the top of said inner piston.

20. The concentric cylinder engine of claim 19 wherein the engine being adapted to operate using four distinct phases of operation, an intake phase, a compression phase, a power phase, and an exhaust phase, whereby each phase being completed in only two strokes of each piston and a single crankshaft revolution due to the simultaneous operation of the two pistons.

* * * * *